US010917718B2

(12) United States Patent
Seo et al.

(10) Patent No.: US 10,917,718 B2
(45) Date of Patent: Feb. 9, 2021

(54) AUDIO SIGNAL PROCESSING METHOD AND DEVICE

(71) Applicant: GAUDIO LAB, INC., Seoul (KR)

(72) Inventors: Jeonghun Seo, Seoul (KR); Sangbae Chon, Seoul (KR); Sewoon Jeon, Daejeon (KR); Yonghyun Baek, Gangwon-do (KR)

(73) Assignee: GAUDIO LAB, INC., Seoul (KR)

( * ) Notice: Subject to any disclaimer, the term of this patent is extended or adjusted under 35 U.S.C. 154(b) by 0 days.

(21) Appl. No.: 16/586,830

(22) Filed: Sep. 27, 2019

(65) Prior Publication Data

US 2020/0029153 A1 Jan. 23, 2020

Related U.S. Application Data

(63) Continuation of application No. PCT/KR2018/003917, filed on Apr. 3, 2018.

(30) Foreign Application Priority Data

Apr. 3, 2017 (KR) ..... 10-2017-0043004

(51) Int. Cl.
*H04R 3/00* (2006.01)
*G10L 21/0216* (2013.01)
(Continued)

(52) U.S. Cl.
CPC ..... *H04R 3/005* (2013.01); *G10L 21/0216* (2013.01); *H04R 1/1083* (2013.01);
(Continued)

(58) Field of Classification Search
CPC ..... H04R 3/005; H04R 1/1083; H04R 1/406; H04R 2201/401; H04R 2430/20;
(Continued)

(56) References Cited

U.S. PATENT DOCUMENTS

2012/0128160 A1 5/2012 Kim et al.
2012/0288114 A1 11/2012 Duraiswami et al.
(Continued)

FOREIGN PATENT DOCUMENTS

JP 2008-245254 10/2008
JP 2009-260708 11/2009
WO 2018/186656 10/2018

OTHER PUBLICATIONS

International Search Report for PCT/KR2018/003917 dated Jul. 16, 2018 and its English translation from WIPO (now published as WO 2018/186656).
(Continued)

*Primary Examiner* — Andrew L Sniezek
(74) *Attorney, Agent, or Firm* — Ladas & Parry, LLP

(57) ABSTRACT

An audio signal processing apparatus for rendering an input audio signal is disclosed. The audio signal processing apparatus includes a receiving unit, which obtains a plurality of input audio signals corresponding to sounds collected by each of a plurality of sound collecting devices, a processor, which obtains an incidence direction for each frequency component for at least some frequency components of each of the plurality of input audio signals corresponding to a sound incident to each of the plurality of sound collecting devices based on cross-correlations between the plurality of input audio signals, and generates an output audio signal by rendering at least some of the plurality of input audio signals based on the incidence direction for each frequency component, and an output unit, which outputs the generated output audio signal.

19 Claims, 3 Drawing Sheets

(51) Int. Cl.
*H04R 1/10* (2006.01)
*H04R 1/40* (2006.01)
*H04S 3/00* (2006.01)

(52) U.S. Cl.
CPC ..... *H04R 1/406* (2013.01); *H04S 3/008* (2013.01); *H04R 2201/401* (2013.01); *H04R 2430/20* (2013.01); *H04S 2400/15* (2013.01); *H04S 2420/11* (2013.01)

(58) Field of Classification Search
CPC . G10L 21/0216; H04S 3/008; H04S 2400/15; H04S 2420/11
See application file for complete search history.

(56) References Cited

U.S. PATENT DOCUMENTS

2014/0023199 A1* 1/2014 Giesbrecht ..... G10L 21/0216 381/71.1
2020/0021910 A1* 1/2020 Rollow, IV ..... H04R 1/406

OTHER PUBLICATIONS

Written Opinion of the International Searching Authority for PCT/KR2018/003917 dated Jul. 16, 2018 and its English translation by Google Translate (now published as WO 2018/186656).
Thiergart, O. et al., "Geometry-Based Spatial Sound Acquisition Using Distributed Microphone Arrays", in IEEE Transaction on Audio, Speech, and Language Processing, vol. 21, No. 12, pp. 2583-2594, Dec. 2013 (https://ieeexplore.ieee.org/document/6588-324/), See sections III-V.

* cited by examiner

AUDIO SIGNAL PROCESSING METHOD AND DEVICE

CROSS-REFERENCE TO RELATED APPLICATIONS

This application is a continuation of International Patent Application No. PCT/KR2018/003917 filed on Apr. 3, 2018, which claims the priority to Korean Patent Application No. 10-2017-0043004 filed on Apr. 3, 2017, the entire contents of which are incorporated herein by reference.

TECHNICAL FIELD

The present disclosure relates to an audio signal processing method and device, and more particularly, to an audio signal processing method and apparatus for rending an input audio signal to provide an output audio signal.

BACKGROUND ART

A binaural rendering technology is essentially required to provide immersive and interactive audio in a head mounted display (HMD) device. An ambisonic technology may be used to provide an immersive output audio signal to a user through scene-based rendering. Here, the scene-based rendering may be a method of analyzing and resynthesizing and rendering a sound field generated by the emitted sound. In this case, in order to analyze the sound field, a sound collecting array may be configured using a cardioid microphone. For example, a first-order ambisonic microphone may be used. However, when an array structure is generated using the first-order ambisonic microphone, the center of a microphone array may be misaligned with the center of a camera when the array is operated simultaneously with an imaging apparatus for obtaining an image. This is because the size of the array is larger when the first-order ambisonic microphone is used than when an omni-directional microphone is used. Furthermore, since the cardioid microphone is relatively expensive, the price of a system including a cardioid microphone array may increase.

Meanwhile, an omni-directional microphone array may record a sound field generated by a sound source, but individual microphones have no directivity. Therefore, a time delay-based beam forming technique should be used to detect the location of a sound source corresponding to a sound field collected through an omni-directional microphone. In this case, the issue of tone color distortion occurs due to phase inversion in a low-frequency band, and it is difficult to obtain a desired quality. Therefore, it is necessary to develop a technology for generating an audio signal for scene-based rendering by using an omni-directional microphone having a relatively small size.

DISCLOSURE OF THE INVENTION

Technical Problem

An embodiment of the present disclosure is for generating an output audio signal having directivity based on a sound collected by an omni-directional sound collecting device. Furthermore, the present disclosure may provide, to a user, an output audio signal having directivity by using a plurality of omni-directional sound collecting devices. Furthermore, the present disclosure is for reducing loss of a low-frequency band audio signal which occurs when generating an output audio signal for rendering in which the location and viewpoint of a listener are reflected.

Technical Solution

In accordance with an exemplary embodiment of the present disclosure, an audio signal processing apparatus for generating an output audio signal by rendering an input audio signal includes: a receiving unit, which obtains a plurality of input audio signals corresponding to sounds collected by each of a plurality of sound collecting devices, wherein each of the plurality of input audio signals corresponds to sound incident to each of the plurality of sound collection devices; a processor, which obtains an incidence direction for each frequency component for at least some frequency components of each of the plurality of input audio signals based on cross-correlations between the plurality of input audio signals, and generate an output audio signal by rendering at least some of the plurality of input audio signals based on the incidence direction for each frequency component, and an output unit, which outputs the generated output audio signal.

Each of the plurality of input audio signals is an omni-directional signal with same collecting gain for all directions. The processor may generate the output audio signal having a directional pattern determined according to the incident direction for each frequency component, from the omni-directional signal.

The processor may generate the output audio signal by rendering some frequency components of the input audio signal based on the incidence direction for each frequency component. The some frequency components indicate frequency components equal to or lower than at least a reference frequency. The reference frequency is determined based on at least one of array information indicating a structure in which the plurality of sound collecting devices are arranged or frequency characteristics of the sounds collected by each of the plurality of sound collecting devices.

Each of the plurality of input audio signals are decomposed into a first audio signal corresponding to a frequency component equal to or lower than the reference frequency and a second audio signal corresponding to a frequency component that exceeds the reference frequency. The processor may generate a third audio signal by rendering the first audio signal based on the incidence direction for each frequency component, and generate the output audio signal by concatenating the second audio signal and the third audio signal, for each frequency component.

The processor may obtain the incidence direction for each frequency component of each of the plurality of input audio signals, based on array information indicating a structure in which the plurality of sound collecting devices are arranged and the cross-correlations.

The processor may obtain time differences between each of the plurality of input audio signals based on the cross-correlations, and obtain the incident direction for each frequency component of each of the plurality of input audio signals based on the time differences normalized with a maximum time delay. The maximum time delay is determined based on the distance between the plurality of sound collection devices.

A first input audio signal, which is one of the plurality of input audio signals, corresponds to a sound collected by a first sound collecting device which is one of the plurality of sound collecting devices. The processor may obtain a first gain for each frequency component corresponding to a location of the first sound collecting device and a second gain for each frequency component corresponding to a virtual location, based on the incidence direction for each frequency component of the first input audio signal, wherein the virtual location indicates a specific point in a sound scene which is the same as a sound scene corresponding to the sound collected by the plurality of sound collecting devices, generate a first intermediate audio signal corresponding to the location of the first sound collecting device by converting a sound level for each frequency component of the first input audio signal based on the first gain for each frequency component, generate a second intermediate audio signal corresponding to a virtual location by converting a sound level for each frequency component of the first input audio signal based on the first gain for each frequency component, and generate the output audio signal by synthesizing the first intermediate audio signal and the second intermediate audio signal.

The virtual location is a specific point within a range of a preset angle from the location of the first sound collecting device, based on a center of a sound collecting array comprising the plurality of sound collecting devices. The preset angle is determined based on the array information.

Each of a plurality of virtual locations comprising the virtual location is determined based on a location of each of the plurality of sound collecting devices and the preset angle. The processor may obtain a first ambisonics signal based on the array information, obtain a second ambisonics signal based on the plurality of virtual locations, and generate the output audio signal based on the first ambisonics signal and the second ambisonics signal.

The first ambisonics signal comprises an audio signal corresponding to the location of each of the plurality of sound collecting devices, and the second ambisonics signal comprises an audio signal corresponding to the plurality of virtual locations.

The processor may set a sum of an energy level for each frequency component of the first intermediate audio signal and an energy level for each frequency component of the second intermediate audio signal to be equal to an energy level for each frequency component of the first input audio signal.

Each of a plurality of virtual locations comprising the virtual location indicate a location of another sound collecting device other than the first sound collecting device among the plurality of sound collecting devices. The processor may obtain each of a plurality of intermediate audio signals corresponding to a location of each of the plurality of sound collecting devices based on the incidence direction for each frequency component of the first input audio signal, and generate the output audio signal by converting the plurality of intermediate audio signals into ambisonics signals based on the array information.

In accordance with another exemplary embodiment of the present disclosure, a method for operating an audio signal processing apparatus for generating an output audio signal by rendering an input audio signal includes: obtaining a plurality of input audio signals corresponding to sounds collected by each of a plurality of sound collecting devices, wherein each of the plurality of input audio signals corresponds to a sound incident to each of the plurality of sound collection devices, obtaining an incidence direction for each frequency component for at least some frequency components of each of the plurality of input audio signals based on cross-correlations between the plurality of input audio signals, generating an output audio signal by rendering at least some of the plurality of input audio signals based on the incidence direction for each frequency component, and outputting the generated output audio signal.

Each of the plurality of input audio signals is an omni-directional signal with same collecting gain for all directions. Here, the generating the output audio signal is generating the output audio signal having a directional pattern determined according to the incident direction for each frequency component, from the omni-directional signal.

The generating the output audio signal is generating the output audio signal by rendering some frequency components of the input audio signal based on the incidence direction for each frequency component, wherein the some frequency components indicate frequency components equal to or lower than at least a reference frequency, and wherein the reference frequency is determined based on at least one of array information indicating a structure in which the plurality of sound collecting devices are arranged or frequency characteristics of the sounds collected by each of the plurality of sound collecting devices.

Each of the plurality of input audio signals are decomposed into a first audio signal corresponding to a frequency component equal to or lower than the reference frequency and a second audio signal corresponding to a frequency component that exceeds the reference frequency. Here, the generating the output audio signal comprises: generating a third audio signal by rendering the first audio signal based on the incidence direction for each frequency component; and generating the output audio signal by concatenating the second audio signal and the third audio signal for each frequency component.

A first input audio signal which is one of the plurality of input audio signals corresponds to a sound collected by a first sound collecting device which is one of the plurality of sound collecting devices. Here, the generating the output audio signal comprises: obtaining a first gain for each frequency component corresponding to a location of the first sound collecting device and a second gain for each frequency component corresponding to a virtual location, based on the incidence direction for each frequency component of the first input audio signal, wherein the virtual location indicates a specific point in a sound scene which is the same as a sound scene corresponding to the sound collected by the plurality of sound collecting devices; generating a first intermediate audio signal corresponding to the location of the first sound collecting device by converting a sound level for each frequency component of the first input audio signal based on the first gain for each frequency component; generating a second intermediate audio signal corresponding to a virtual location by converting a sound level for each frequency component of the first input audio signal based on the first gain for each frequency component; and generating the output audio signal by synthesizing the first intermediate audio signal and the second intermediate audio signal.

Each of a plurality of virtual locations comprising the virtual location is determined based on a location of each of the plurality of sound collecting devices. Here, the generating the output audio signal comprises: obtaining a first ambisonics signal based on array information indicating a structure in which the plurality of sound collecting devices are arranged; obtaining a second ambisonics signal based on the plurality of virtual locations; and generating the output audio signal based on the first ambisonics signal and the second ambisonics signal.

A computer-readable recording medium according to another aspect may include a recording medium in which a program for executing the above method is recorded.

Advantageous Effects

An audio signal processing apparatus and method according to an embodiment of the present disclosure may provide, to a user, an output audio signal having directivity by using a plurality of omni-directional sound collecting devices.

Furthermore, the audio signal processing apparatus and method of the present disclosure may reduce loss of a low-frequency band audio signal which occurs when generating an output audio signal for rendering in which the location and view-point of the listener are reflected.

MODE FOR CARRYING OUT THE INVENTION

Figure 1:
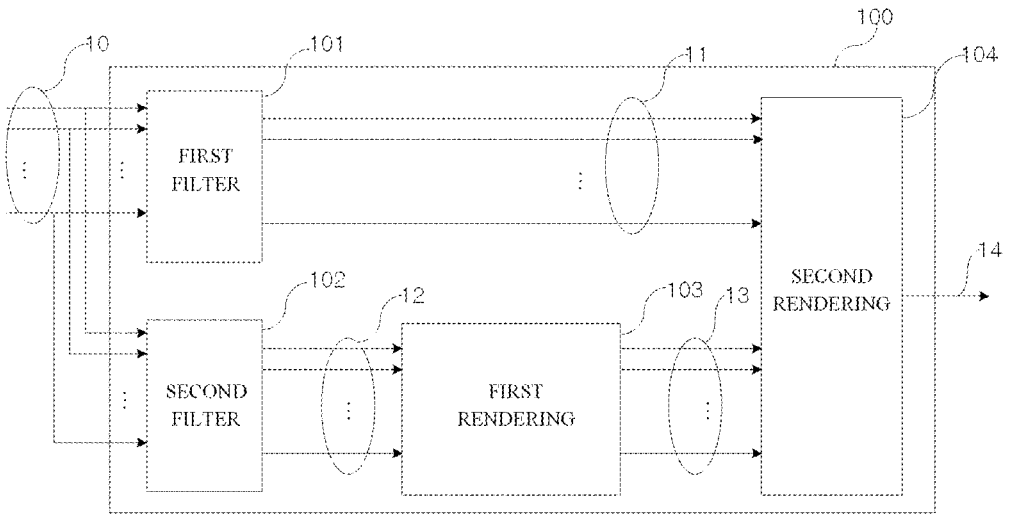
FIG. 1 is a schematic diagram illustrating a method for operating an audio signal processing apparatus according to an embodiment of the present disclosure.

Hereinafter, embodiments of the present invention will be described in detail with reference to the accompanying drawings so that the embodiments of the present invention can be easily carried out by those skilled in the art. However, the present invention may be implemented in various different forms and is not limited to the embodiments described herein. Some parts of the embodiments, which are not related to the description, are not illustrated in the drawings in order to clearly describe the embodiments of the present disclosure. Like reference numerals refer to like elements throughout the description.

When it is mentioned that a certain part "includes" or "comprises" certain elements, the part may further include other elements, unless otherwise specified. When it is mentioned that a certain part "includes" or "comprises" certain elements, the part may further include other elements, unless otherwise specified.

The present disclosure relates to a method for an audio signal processing apparatus to generate an output audio signal having directivity by rendering an input audio signal. According to the present disclosure, an input audio signal corresponding to a sound acquired by a plurality of omni-directional sound collecting devices may be converted into an audio signal for rendering in which a location and view-point of a listener are reflected. For example, an audio signal processing apparatus and method of the present disclosure may generate an output audio signal for binaural rendering based on a plurality of input audio signals. Here, the plurality of input audio signals may be audio signals corresponding to sounds acquired at different locations in the same sound scene.

The audio signal processing apparatus and method according to an embodiment of the present disclosure may analyze sounds acquired by each of the plurality of sound collecting devices to estimate a location of a sound source in which a collected sound corresponds to a plurality of sound components included in the sound. Furthermore, the audio signal processing apparatus and method may convert an omni-directional input audio signal corresponding to a sound collected by an omni-directional sound collecting device into an output audio signal exhibiting directivity. Here, the audio signal processing apparatus and method may use the estimated location of the sound. In this manner, the audio signal processing apparatus and method may provide, to a user, an output audio signal having directivity by using a plurality of omni-directional sound collecting devices.

Furthermore, the audio signal processing apparatus and method according to an embodiment of the present disclosure may determine a gain for each frequency component of an audio signal corresponding to each of the plurality of sound collecting devices based on an incidence direction of a collected sound. The audio signal processing apparatus and method may generate an output audio signal by applying the gain for each frequency component of an audio signal corresponding to each of the plurality of sound collecting devices to each audio signal corresponding to a collected sound. In this manner, the audio signal processing apparatus and method may reduce loss of a low-frequency band audio signal which occurs when generating a directional pattern for each frequency component.

Hereinafter, the present invention will be described in detail with reference to the accompanying drawings.

FIG. 1 is a schematic diagram illustrating a method for operating an audio signal processing apparatus 100 according to an embodiment of the present disclosure. According to an embodiment, the audio signal processing apparatus 100 may generate an output audio signal 14 by rendering an input audio signal 10. For example, the audio signal processing apparatus 100 may obtain a plurality of input audio signals 10. Here, the plurality of input audio signals 10 may be audio signals corresponding to sounds collected by each of a plurality of sound collecting devices arranged in different locations. The input audio signals may be signals recorded using a sound collecting array including the plurality of sound collecting devices. Here, the sound collecting device may include a microphone. The sound collecting device and the sound collecting array will be described in detail with reference to FIG. 2.

According to an embodiment, the audio signal processing apparatus 100 may decompose each of the plurality of obtained input audio signals 10 into first audio signals 11 which are not subject to first rendering 103 and second audio signals 12 which are subject to the first rendering 103. For example, the first audio signals 11 and the second audio signals 12 may include at least some of the plurality of input audio signals 10. In detail, the first audio signals 11 and the second audio signals 12 may include at least one input audio signal among the plurality of input audio signals 10. In this case, the number of the first audio signals 11 and the number of the second audio signals 12 may differ from the number of the plurality of input audio signals 10. Furthermore, the first audio signals 11 and the second audio signals 12 may include at least some frequency components of each of the plurality of input audio signals 10. Here, the frequency component may include a frequency band and a frequency bin.

For example, the audio signal processing apparatus 100 may decompose each of the plurality of input audio signals 10 by using a first filter 101 and a second filter 102. For example, the audio signal processing apparatus 100 may generate the first audio signals 11 by filtering each of the plurality of input audio signals 10 based on the first filter 101. Furthermore, the audio signal processing apparatus 100 may generate the second audio signals 12 by filtering each of the plurality of input audio signals 10 based on the second filter 102. According to an embodiment, the audio signal processing apparatus 100 may generate the first filter 101 and the second filter 102 based on at least one reference frequency. Here, the reference frequency may include a cut-off frequency.

Furthermore, the audio signal processing apparatus 100 may determine the reference frequency based on at least one of array information indicating a structure in which the plurality of sound collecting devices are arranged or frequency characteristics of sounds collected by each of the plurality of sound collecting devices. Here, the array information may include at least one of information about the number of the plurality of sound collecting devices included in the sound collecting array, information about a form of arrangement of the sound collecting device, or information about a distance between the sound collecting devices. In detail, the audio signal processing apparatus 100 may determine the reference frequency based on the distance between the plurality of sound collecting devices. This is because a level of confidence of a cross-correlation obtained during the first rendering 103 becomes equal to or lower than a reference value in the case of a sound wave having a wavelength shorter than the distance between the plurality of sound collecting devices.

According to an embodiment, the audio signal processing apparatus 100 may decompose each of the input audio signals into low-band audio signals corresponding to a frequency component equal to or lower than the reference frequency and high-band audio signals corresponding to a frequency component that exceeds the reference frequency. At least one of the plurality of input audio signals 10 may not include the high-band audio signal or the low-band audio signal. In this case, the input audio signal may be included only in the first audio signal 11 or in the second audio signal 12.

According to an embodiment, the first audio signal 11 may indicate a frequency component equal to or lower than at least the reference frequency. That is, the first audio signal 11 may indicate the high-band audio signal, and the second audio signal 12 may indicate the low-band audio signal. Furthermore, the first filter may indicate a high pass filter (HPF), and the second filter may indicate a low pass filter (LPF). This is because a process of the first rendering 103, which will be described later, may not be required due to characteristics of the high-band audio signal. Since attenuation of the high-band audio signal according to an incidence direction of a sound source is relatively large, directivity of the high-band audio signal may be expressed based on a level difference between sounds collected by each of the plurality of sound collecting devices.

According to an embodiment, the audio signal processing apparatus 100 may generate third audio signals 13 through the first rendering 103 of the second audio signals 12. The process of the first rendering 103 may include a process of applying a specific gain to a sound level of each of the second audio signal 12 for each frequency component. Here, the gain for each frequency component may be determined based on an incidence direction for each frequency component of a sound incident to a sound collecting device which has collected a sound corresponding to each of the second audio signals 12. For example, the audio signal processing apparatus 100 may generate the third audio signals 13 by rendering the second audio signals based on the incidence direction for each frequency component of each of the second audio signals. A method for the audio signal processing apparatus 100 to generate the third audio signals 13 will be described in detail with reference to FIG. 3.

According to an embodiment, the audio signal processing apparatus 100 may generate the output audio signal 14 through second rendering 104 of the first audio signals 11 and the third audio signals 13. For example, the audio signal processing apparatus 100 may synthesize the first audio signals 11 and the third audio signals 13. The audio signal processing apparatus 100 may synthesize the first audio signals 11 and the third audio signals 13 for each frequency component. For example, the audio signal processing apparatus 100 may concatenate the first audio signals 11 and the third audio signals 13 for each audio signal. This is because each of the first audio signals 11 and the third audio signals 13 may include different frequency components for any one of the plurality of input audio signals 10.

Furthermore, the audio signal processing apparatus 100 may generate the output audio signal 14 through the second rendering 104 of the first audio signals 11 and the third audio signals 13 based on the array information indicating the structure in which the plurality of sound collecting devices are arranged. In detail, the audio signal processing apparatus 100 may use location information indicating a relative location of each of the plurality of sound collecting devices based on the sound collecting array and the number of the plurality of sound collecting devices. Here, the location information indicating the relative location of the sound collecting devices may be expressed by at least one of a distance, an azimuth, or an elevation from a center of the sound collecting array to the sound collecting devices.

For example, the audio signal processing apparatus 100 may render the first audio signals 11 and the third audio signals based on the array information to generate the output audio signal in which the location and view-point of a listener are reflected. In detail, the audio signal processing apparatus 100 may render the first audio signals 11 and the third audio signals 13 by matching the location of the listener to the center of the sound collecting array. Furthermore, the audio signal processing apparatus 100 may render the first audio signals 11 and the third audio signals 13 based on the relative location of the plurality of sound collecting devices included in the sound collecting array based on the view-point of the listener. The audio signal processing apparatus 100 may match the first audio signals 11 and the third audio signals 13 to a plurality of loud-speakers to render the first audio signals 11 and the third audio signals 13. Furthermore, the audio signal processing apparatus 100 may generate the output audio signal by binaural-rendering the first audio signals 11 and the third audio signals 13.

According to an embodiment, the audio signal processing apparatus 100 may convert the first audio signals 11 and the third audio signals 13 into ambisonics signals. Ambisonics is one of techniques for enabling the audio signal processing apparatus 100 to obtain information about a sound field and reproduce a sound by using the obtained information. In the present disclosure, the ambisonics signal may include a higher order ambisonics (HoA) signal and a first order ambisonics (FoA) signal. Ambisonics may indicate that a sound source corresponding to a sound component included in a sound collectable at a specific point is expressed in a space. Accordingly, the audio signal processing apparatus 100 is required to obtain information about sound components corresponding to all of directions incident to one point in a sound scene in order to obtain the ambisonics signal. According to an embodiment, the audio signal processing apparatus 100 may obtain a basis of spherical harmonics based on the array information. In detail, the audio signal processing apparatus 100 may obtain the basis of the spherical harmonics by using coordinate values of the sound collecting device in a spherical coordinate system. Here, the audio signal processing apparatus 100 may project a microphone array signal to a spherical harmonics domain based on each basis of the spherical harmonics.

For example, when the distance from the center of the sound collecting array to the plurality of sound collecting devices is constant, the relative location of the plurality of sound collecting devices may be expressed as an azimuth and an elevation. Here, the audio signal processing apparatus 100 may obtain the spherical harmonics having, as factors, an order of spherical harmonics and the azimuth and elevation of each sound collecting device. Furthermore, the audio signal processing apparatus 100 may obtain the ambisonics signal by using a pseudo inverse matrix of spherical harmonics. Here, the ambisonics signal may be represented by ambisonics coefficients corresponding to the spherical harmonics.

For example, the audio signal processing apparatus 100 may convert the first audio signals 11 and the third audio signals 13 into ambisonics signals based on the array information. In detail, the audio signal processing apparatus 100 may convert the first audio signals 11 and the third audio signals 13 into ambisonics signals based on the location information indicating the relative location of each of the plurality of sound collecting devices. Alternatively, according to the embodiment described below with reference to FIG. 3, when the audio signal processing apparatus 100 uses a plurality of virtual locations different from the location of each of the plurality of sound collecting devices, the audio signal processing apparatus 100 may additionally use the virtual locations. In this case, the audio signal processing apparatus 100 may synthesize a first ambisonics signal obtained based on the array information and a second ambisonics signal obtained based on the plurality of virtual locations to generate the output audio signal.

Meanwhile, the audio signal processing apparatus 100 may perform the first rendering 103 and the second rendering 104 in a time domain or frequency domain. According to an embodiment, the audio signal processing apparatus 100 may convert input audio signals of a time domain into signals of a frequency domain to decompose each of the input audio signals by frequency component. In this case, the audio signal processing apparatus 100 may generate the output audio signal by rendering the frequency domain signals. Alternatively, the audio signal processing apparatus 100 may generate the output audio signal by rendering the time domain signals decomposed by frequency component by using a band pass filter in a time domain.

Meanwhile, although FIG. 1 illustrates operation of the audio signal processing apparatus 100 as being divided into blocks for convenience, the present disclosure is not limited thereto. For example, the operations of each block of the audio signal processing apparatus illustrated in FIG. 1 may overlap each other or may be performed in parallel. Furthermore, the audio signal processing apparatus 100 may perform the operations of each stage in an order different from that illustrated in FIG. 1. Furthermore, although the following descriptions pertaining to the sound collecting array and the sound collecting device are based on a two-dimensional space for convenience, the same method may be applied for a three-dimensional structure.

Figure 2:
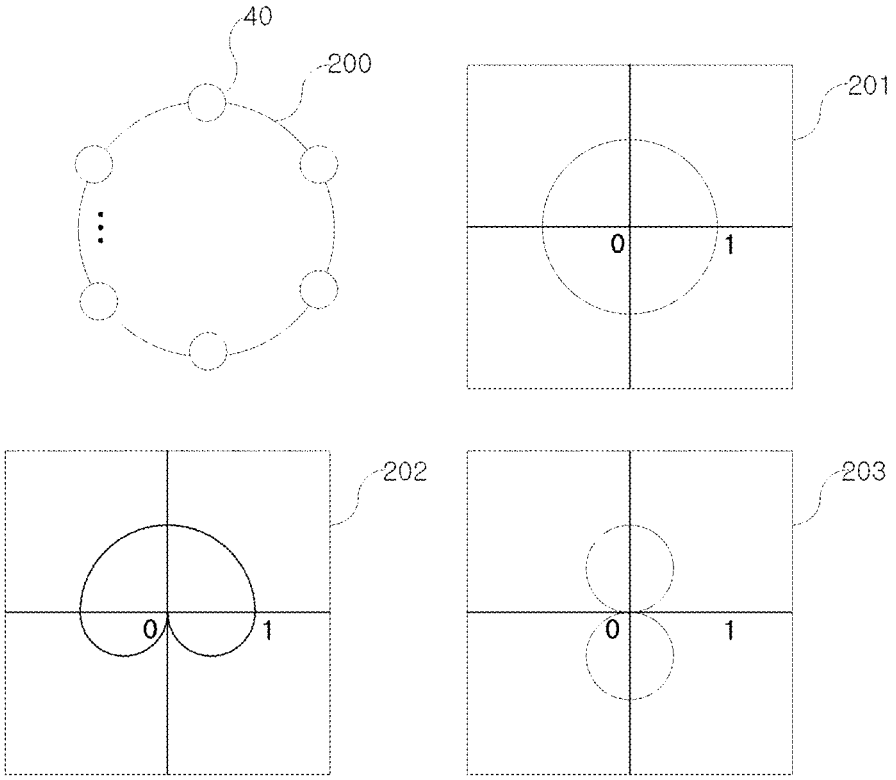
FIG. 2 is a diagram illustrating a sound collecting array according to an embodiment of the present disclosure.

Hereinafter, the sound collecting device for collecting a sound corresponding to an input audio signal according to an embodiment of the present disclosure will be described. FIG. 2 is a diagram illustrating a sound collecting array 200 according to an embodiment of the present disclosure. Referring to FIG. 2, the sound collecting array 200 may include a plurality of sound collecting devices 40. FIG. 2 illustrates the sound collecting array 200 as including six sound collecting devices 40 arranged in a circular form, but the present disclosure is not limited thereto. For example, the sound collecting array 200 may include more or fewer sound collecting devices 40 than the number of the sound collecting devices 40 illustrated in FIG. 2. Furthermore, the sound collecting array 200 may include the sound collecting devices 40 arranged in various forms such as a cube or equilateral triangle other than a circular or spherical form.

Each of the plurality of sound collecting devices 40 included in the sound collecting array 200 may collect a sound that is omni-directionally incident to the sound collecting devices 40. Furthermore, each of the sound collecting devices 40 may transmit an audio signal corresponding to a collected sound to the audio signal processing apparatus 100. Alternatively, the sound collecting array 200 may gather sounds collected by each of the sound collecting devices 40. Furthermore, the sound collecting array 200 may transmit, to the audio signal processing apparatus 100, gathered audio signals via one sound collecting device 40 or an additional signal processing apparatus (not shown). Furthermore, the audio signal processing apparatus may obtain, together with an audio signal, information about the sound collecting array 200 that has collected a sound corresponding to the audio signal. For example, the audio signal processing apparatus 100 may obtain, together with a plurality of input audio signals, at least one of information about the location, within the sound collecting array 200, of the sound collecting devices 40 that have collected each input audio signal or the above-mentioned array information.

According to an embodiment, the sound collecting device 40 may include at least one of an omni-directional microphone or a directional microphone. For example, the directional microphone may include a uni-directional microphone and a bi-directional microphone. Here, the uni-directional microphone may represent a microphone having an increased collecting gain for a sound that is incident in a specific direction. The collecting gain may represent sound collecting sensitivity of a microphone. Furthermore, the bi-directional microphone may represent a microphone having an increased collecting gain for a sound that is incident in a forward or backward direction. Reference number 202 of FIG. 2 indicates an example of a collecting gain 202 for each azimuth centered on the location of the uni-directional microphone. Although FIG. 2 illustrates the collecting gain 202 for each azimuth of the uni-directional microphone in a cardioid form, the present disclosure is not limited thereto. Furthermore, reference number 203 of FIG. 2 indicates an example of a collecting gain 203 for each azimuth of the bi-directional microphone.

Unlike the above microphone, the omni-directional microphone may collect a sound that is incident omni-directionally with the same collecting gain 201. Furthermore, a frequency characteristic of a sound collected by the omni-directional microphone may be flat over an entire frequency band. Accordingly, when the omni-directional microphone is used in the sound collecting array, it may be difficult to effectively perform interactive rendering even if a sound field acquired from a microphone array is analyzed. This is because the location of a sound source corresponding to a plurality of sound components included in a sound collected through the omni-directional microphone cannot be estimated. However, the omni-directional microphone has a low price in comparison with the directional microphone, and when an array is configured with the omni-directional microphones, the array may be easily used together with an image capturing device. This is because the omni-directional microphone has a smaller size than that of the directional microphone.

The audio signal processing apparatus 100 according to an embodiment of the present disclosure may generate the output audio signal having directivity by rendering an input audio signal collected through a sound collecting array which uses the omni-directional microphone. In this manner, the audio signal processing apparatus 100 may generate the output audio signal having sound image localization performance similar to that of a directional microphone array by using the omni-directional microphone.

Figure 3:
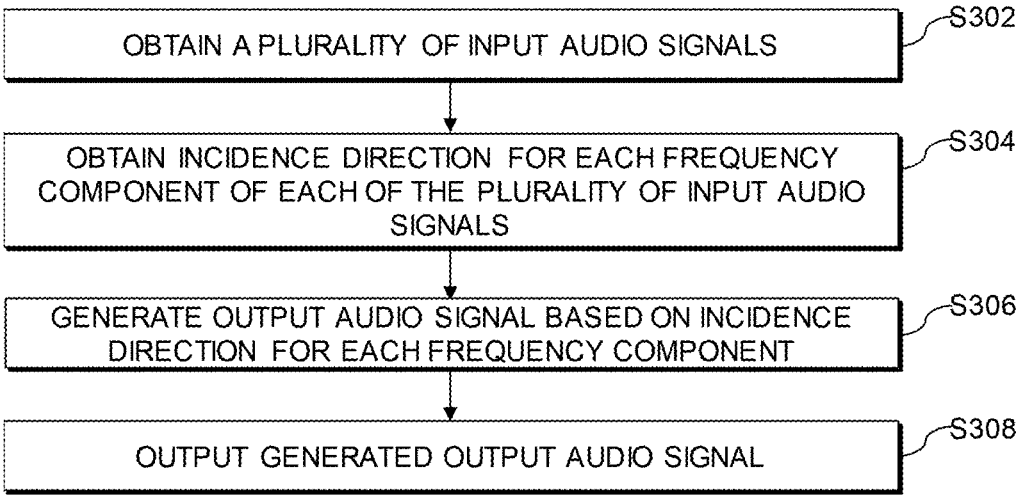
FIG. 3 is a flowchart illustrating a method for operating an audio signal processing apparatus according to an embodiment of the present disclosure.

Described below with reference to FIG. 3 is a method for the audio signal processing apparatus 100 to generate an output audio signal based on an incidence direction for each frequency component of a plurality of input audio signals. FIG. 3 is a flowchart illustrating a method for operating the audio signal processing apparatus 100 according to an embodiment of the present disclosure.

In operation 5302, the audio signal processing apparatus 100 may obtain a plurality of input audio signals. For example, the audio signal processing apparatus 100 may obtain the plurality of input audio signals corresponding to sounds collected by each of a plurality of sound collecting devices. The audio signal processing apparatus 100 may receive the input audio signal from each of the plurality of sound collecting devices. Alternatively, the audio signal processing apparatus 100 may also receive, from another apparatus connected to the sound collecting device, the input audio signal corresponding to a sound collected by the sound collecting device. Some of processes in operations 5304 and 5306 described below may be selectively applied to some of the plurality of input audio signals or some frequency components of the input audio signals as described above with reference to FIG. 1. However, the present disclosure is not limited thereto.

In operation 5304, the audio signal processing apparatus 100 may obtain an incidence direction for each frequency component of each of the plurality of input audio signals. For example, the audio signal processing apparatus 100 may obtain, based on the cross-correlations between the plurality of input audio signals, the incidence direction for each frequency component of the plurality of input audio signals incident to each of the plurality of sound collecting devices. In detail, the incidence direction for each frequency component may be expressed as an incidence angle at which a specific frequency component of the sound is incident to the sound collecting device. For example, the incidence angle may be expressed as an azimuth and an elevation in a spherical coordinate system having an origin which is the location of the sound collecting device.

Furthermore, the cross-correlations between the plurality of input audio signals may indicate similarity between audio signals for each frequency component. The audio signal processing apparatus 100 may calculate, for each frequency component, the cross-correlation between any two input audio signals among the plurality of input audio signals. Alternatively, the audio signal processing apparatus 100 may group some of a plurality of frequency components. In this case, the audio signal processing apparatus 100 may obtain the cross-correlations between the plurality of input audio signals for each of grouped frequency bands. In this manner, the audio signal processing apparatus 100 may control a calculation amount according to calculation processing performance of the audio signal processing apparatus 100. Furthermore, the audio signal processing apparatus 100 may smooth the cross-correlations between frames. In this manner, the audio signal processing apparatus 100 may reduce, for each frame, a change in the cross-correlations for each frequency component.

In detail, the audio signal processing apparatus 100 may obtain a time difference for each frequency component based on the cross-correlations. Here, the time difference for each frequency component may indicate a time difference for each frequency component between sounds incident to at least two sound collecting devices. Furthermore, the audio signal processing apparatus 100 may obtain the incidence direction for each frequency component of each of the plurality of input audio signals based on the time difference for each frequency component.

According to an embodiment, the audio signal processing apparatus 100 may obtain the incidence direction for each frequency component of each of the plurality of input audio signals based on the above-mentioned array information and the cross-correlation. For example, the audio signal processing apparatus 100 may determine, based on the array information, the location of at least one second sound collecting device closest to a first sound collecting device among the plurality of sound collecting devices. Furthermore, the audio signal processing apparatus 100 may obtain the cross-correlation between a first input audio signal corresponding to a sound collected by the first sound collecting device and a second input audio signal. Here, the second input audio signal may represent any one of at least one audio signal corresponding to a sound collected by the at least one second sound collecting device. Furthermore, the audio signal processing apparatus 100 may determine the incidence direction for each frequency component of the first input audio signal based on the cross-correlation between the first input audio signal and the at least one second input audio signal.

According to another embodiment, the audio signal processing apparatus 100 may obtain, based on the cross-correlation, the incidence direction for each frequency component of each of the plurality of input audio signals based on the center of the sound collecting array. In this case, the audio signal processing apparatus 100 may obtain, based on the array information, the relative location of each of the plurality of sound collecting devices based on the center of the sound collecting array. Furthermore, the audio signal processing apparatus 100 may obtain, based on the relative location of each of the plurality of sound collecting devices, the incidence direction in which a specific frequency component of the input audio signal is incident based on each of the plurality of sound collecting devices.

In operation 5306, the audio signal processing apparatus 100 may generate an output audio signal based on the incidence direction. For example, the audio signal processing apparatus 100 may generate the output audio signal by rendering at least some part of the plurality of input audio signals based on the incidence direction for each frequency component. Here, as described above with reference to FIG. 1, the at least some part of the plurality of input audio signals may represent input audio signals corresponding to at least some frequency components or at least one input audio signal.

According to an embodiment, the audio signal processing apparatus 100 may generate a plurality of first intermediate audio signals corresponding to the locations of corresponding sound collecting devices based on the incidence direction for each frequency component of each of the plurality of input audio signals obtained in operation 5304. For example, the audio signal processing apparatus 100 may generate the first intermediate audio signal corresponding to the location of the first sound collecting device by rendering the first input audio signal based on the incidence direction for each frequency component of the first input audio signal. Here, the location of the first sound collecting device may indicate the relative location of the first sound collecting device based on the center of the above-mentioned sound collecting array.

Furthermore, the audio signal processing apparatus 100 may generate the second intermediate audio signal corresponding to a virtual location by rendering the first input audio signal based on the incidence direction for each frequency component of each of the plurality of input audio signals. Here, the virtual location may indicate a specific point in a sound scene which is the same as a sound scene corresponding to a sound collected by the plurality of sound collecting devices. Furthermore, the sound scene may represent a specific space-time indicating a time and place at which a sound corresponding to a specific audio signal has been captured. Furthermore, an audio signal corresponding to a specific location may indicate a virtual audio signal virtually collected at a corresponding location of the sound scene.

In detail, the audio signal processing apparatus 100 may obtain a gain for each frequency component corresponding to the location of the first sound collecting device based on the incidence direction for each frequency component of the first input audio signal. Furthermore, the audio signal processing apparatus 100 may generate the first intermediate audio signal by rendering the first input audio signal based on the gain for each frequency component corresponding to the location of the first sound collecting device. For example, the audio signal processing apparatus 100 may generate the first intermediate audio signal by converting a sound level for each frequency component of the first input audio signal based on the gain for each frequency component.

Furthermore, the audio signal processing apparatus 100 may obtain a gain for each frequency component corresponding to a virtual location based on the incidence direction for each frequency component of the first input audio signal. Furthermore, the audio signal processing apparatus 100 may generate the second intermediate audio signal by rendering the first input audio signal based on the gain for each frequency component corresponding to the virtual location. For example, the audio signal processing apparatus 100 may generate the second intermediate audio signal by converting a sound level for each frequency component of the first input audio signal based on the gain for each frequency component.

Here, the second intermediate audio signal may include at least one virtual audio signal corresponding to a sound collected at one or more virtual locations. The audio signal processing apparatus 100 may generate the output audio signal exhibiting directivity by using the virtual audio signal corresponding to the virtual location. In this manner, the audio signal processing apparatus 100 may convert the omni-directional first input audio signal into a directional audio signal having a gain that varies according to the incidence direction of a sound. Based on an input audio signal obtained through an omni-directional sound collecting device, the audio signal processing apparatus 100 may achieve an effect equivalent to obtaining an audio signal through a directional sound collecting device.

According to an embodiment, the audio signal processing apparatus 100 may obtain the gain for each frequency component determined by the incidence direction based on cardioid illustrated in FIG. 2 (e.g., collecting gain 202 of FIG. 2). However, in the present disclosure, a method for the audio signal processing apparatus 100 to determine the gain for each frequency component according to the incidence direction for each frequency component is not limited to a specific method. Furthermore, the audio signal processing apparatus 100 may configure so that a sum of an energy level for each frequency component of the first intermediate audio signal and an energy level for each frequency component of the second intermediate audio signal is equal to an energy level for each frequency component of the first input audio signal. In this manner, the audio signal processing apparatus 100 may maintain the energy level of an initial input audio signal.

For example, the audio signal processing apparatus 100 may determine the gain for frequency component having a value of '1' or '0'. In this case, the first input audio signal may be the same as an audio signal corresponding to either a virtual location or the location of the first sound collecting device. For example, when the gain of a specific frequency component corresponding to the location of the first sound collecting device is '1', the gain of a specific frequency component corresponding to the virtual location may be '0'. On the contrary, when the gain of a specific frequency component corresponding to the location of the first sound collecting device is '0', the gain of a specific frequency component corresponding to the virtual location may be '1'. Furthermore, the audio signal processing apparatus 100 may determine a method of obtaining a virtual gain and the gain for each frequency component based on at least one of calculation processing performance of a processor included in the audio signal processing apparatus 100, performance of a memory, or a user input. Here, the processing performance of the audio signal processing apparatus may include a processing speed of the processor included in the audio signal processing device.

According to an embodiment, the audio signal processing apparatus 100 may determine a virtual location based on the location of the first sound collecting device. Here, the location of the first sound collecting device may indicate the relative location of the first sound collecting device based on the center of the above-mentioned sound collecting array. For example, the virtual location may indicate a specific point within a preset angle range from the location of the first sound collecting device based on the center of the sound collecting array. Here, the preset angle may range from about 90-degree to about 270-degree. The preset angle may include at least one of an azimuth or an elevation. For example, the virtual location may indicate a location having an azimuth or elevation of 180-degree from the location of the first sound collecting device based on the center of the sound collecting array. However, the present disclosure is not limited thereto.

According to an embodiment, the audio signal processing apparatus 100 may determine a plurality of virtual locations based on the location of each of the plurality of sound collecting devices. For example, the audio signal processing apparatus 100 may determine the plurality of virtual locations indicating locations different from the locations of the plurality of sound collecting devices based on the preset angle. Furthermore, the audio signal processing apparatus 100 may generate the output audio signal by converting an intermediate audio signal into an ambisonics signal as described above with reference to FIG. 1. The audio signal processing apparatus 100 may obtain a first ambisonics signal based on the array information. Furthermore, the audio signal processing apparatus 100 may obtain a second ambisonics signal based on the plurality of virtual locations.

In detail, the audio signal processing apparatus 100 may obtain the basis of a first spherical harmonics based on the array information. The audio signal processing apparatus 100 may obtain a first ambisonics conversion matrix on the basis the location of each of the plurality of sound collecting devices included in the array information. Here, the ambisonics conversion matrix may represent the above-mentioned pseudo inverse matrix corresponding to spherical harmonics. The audio signal processing apparatus 100 may convert, based on the first ambisonics conversion matrix, an audio signal corresponding to the location of each of the plurality of sound collecting devices into the first ambisonics signal. Furthermore, the audio signal processing apparatus 100 may obtain the basis of a second spherical harmonics based on the plurality of virtual locations. The audio signal processing apparatus 100 may obtain a second ambisonics conversion matrix based on the plurality of virtual locations. The audio signal processing apparatus 100 may convert, based on the second ambisonics conversion matrix, an audio signal corresponding to each of the plurality of virtual locations into the second ambisonics signal. Furthermore, the audio signal processing apparatus 100 may generate the output audio signal based on the first ambisonics signal and the second ambisonics signal.

According to an embodiment, the virtual location may indicate the location of another sound collecting device other than the sound collecting device that has collected a specific input audio signal among the plurality of sound collecting devices. For example, the plurality of virtual locations may indicate the locations of the plurality of sound collecting devices except for the first sound collecting device. In this case, the audio signal processing apparatus 100 may obtain a plurality of intermediate audio signals corresponding to the location of each of the plurality of sound collecting devices based on the incidence direction for each frequency component of the first input audio signal. Furthermore, the audio signal processing apparatus 100 may generate the output audio signal by synthesizing the plurality of intermediate audio signals.

In detail, the audio signal processing apparatus 100 may obtain the gain for each frequency component corresponding to the location of each of the plurality of sound collecting devices based on the incidence direction for each frequency component. Furthermore, the audio signal processing apparatus 100 may generate the output audio signal by rendering the first input audio signal based on the gain for each frequency component. For example, the audio signal processing apparatus 100 may generate the output audio signal by converting the plurality of intermediate audio signals into ambisonics signals based on the array information as described above with reference to FIG. 1.

Furthermore, according to an embodiment, the virtual location may indicate a location of a virtual sound collecting device mapped to the sound collecting device that has collected a sound corresponding to a specific input audio signal. For example, the audio signal processing apparatus 100 may determine the plurality of virtual locations corresponding to each of the plurality of sound collecting devices based on the above-mentioned array information. Furthermore, the audio signal processing apparatus may generate a virtual array including a plurality of virtual sound collecting devices mapped to each of the plurality of sound collecting devices. Here, the plurality of virtual sound collecting devices may be arranged at locations that are point-symmetric with respect to the center of an array including the plurality of sound collecting devices. However, the present disclosure is not limited thereto. A method for the audio signal processing apparatus 100 to generate an output audio signal by using the virtual array will be described in detail with reference to FIGS. 4 and 5.

In operation 5308, the audio signal processing apparatus 100 may output the generated output audio signal. Here, the generated output audio signal may include various types of audio signals as described above. The audio signal processing apparatus 100 may output the output audio signal in another way according to the type of the generated output audio signal. Furthermore, the audio signal processing apparatus 100 may output the output audio signal via an output terminal included in an output unit described below. The audio signal processing apparatus 100 may encode the audio signal to transmit, in a bitstream form, the audio signal to an external apparatus connected wirelessly or by wire.

Through the above-mentioned method, the audio signal processing apparatus 100 may generate the output audio signal including directivity for each frequency component by using the gain for each frequency component. Furthermore, the audio signal processing apparatus 100 may use a plurality of omni-directional audio signals to reduce loss of a low-frequency band audio signal which occurs during a process of generating an audio signal in which the location and view-point of the listener are reflected. Furthermore, the audio signal processing apparatus 100 may provide an immersive sound to the user through the output audio signal including directivity.

Hereinafter, a method for the audio signal processing apparatus 100 to generate a virtual array and generate an output audio signal according to an embodiment of the present disclosure will be described in detail with reference to FIGS. 4 and 5. Here, the virtual array may include the plurality of virtual sound collecting devices arranged at each of the plurality of virtual locations described above with reference to FIG. 3.

Figure 4:
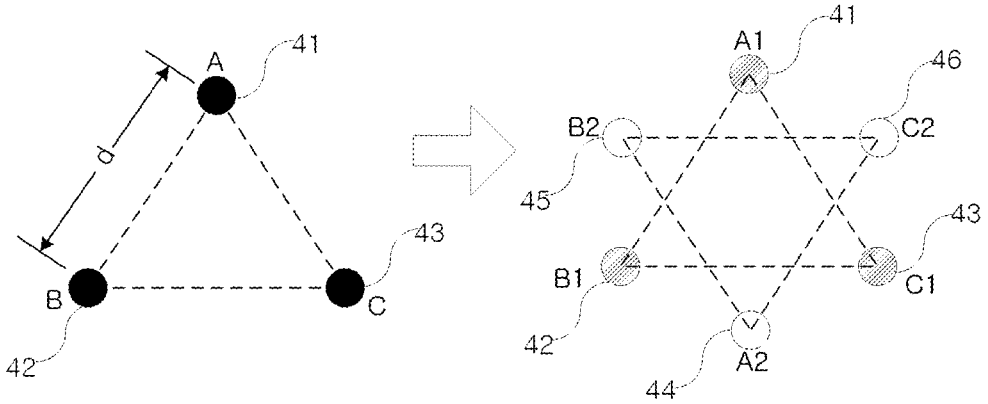
FIG. 4 is a diagram illustrating arrangement of a sound collecting array and locations of virtual sound collecting devices according to an embodiment of the present disclosure.

FIG. 4 is a diagram illustrating arrangement of a sound collecting array and locations of virtual sound collecting devices according to an embodiment of the present disclosure. In FIG. 4, A, B, and C respectively represent a first sound collecting device 41, a second sound collecting device 42, and a third sound collecting device 43 included in the sound collecting array. Furthermore, in FIG. 4, A2, B2, and C2 respectively represent a first virtual sound collecting device 44, a second virtual sound collecting device 45, and a third virtual sound collecting device 46. Here, the first to third virtual sound collecting devices 44 to 46 may indicate virtual sound collecting points generated based on a structure in which the first to third sound collecting devices 41 to 43 are arranged as described above. The first to third virtual sound collecting devices 44, 45, and 46 may respectively correspond to the first to third sound collecting devices 41, 42, and 43. In detail, a first input audio signal corresponding to a sound collected by the first sound collecting device may be converted into a first intermediate audio signal corresponding to the location of the first sound collecting device and a second intermediate audio signal corresponding to the location of the first virtual sound collecting device. For example, the second intermediate audio signal may represent an audio signal having location information of the first virtual sound collecting device as metadata. In FIG. 4, A1, B1, and C1 may have the same geometric locations as A, B, and C. Here, A2, B2, and C2 may be located at positions of point-symmetry with respect to a center of mass of a triangle formed by A1, B1, and C1.

Figure 5:
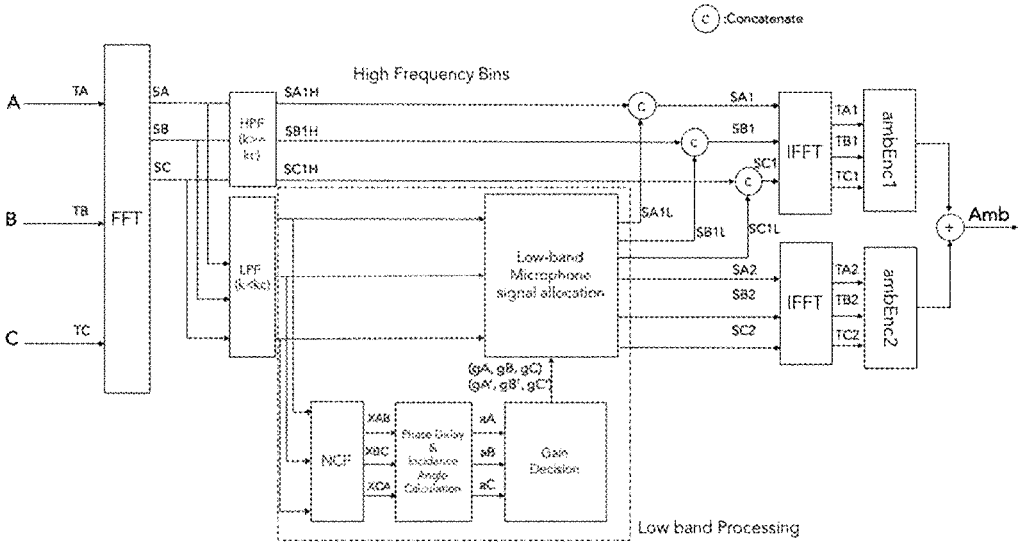
FIG. 5 is a diagram illustrating an example in which an audio signal processing apparatus according to an embodiment of the present disclosure generates an output audio signal.

FIG. 5 is a diagram illustrating an example in which the audio signal processing apparatus 100 according to an embodiment of the present disclosure generates an output audio signal. FIG. 5 illustrates a method of operating the audio signal processing apparatus 100 when a plurality of sound collecting devices are arranged in a triangular form as illustrated in FIG. 5. Although FIG. 5 illustrates operation of the audio signal processing apparatus 100 by dividing the operation into steps, the present disclosure is not limited thereto. For example, the operations of each step of the audio signal processing apparatus illustrated in FIG. 5 may overlap each other or may be performed in parallel. Furthermore, the audio signal processing apparatus 100 may perform the operations of each stage in an order different from that illustrated in FIG. 5.

According to an embodiment, the audio signal processing apparatus 100 may obtain first to third input audio signals TA, TB, and TC corresponding to a sound collected by each of the first to third sound collecting devices 41 to 43. Furthermore, the audio signal processing apparatus 100 may convert time domain signals into frequency domain signals SA[n, k], SB[n, k], and SC[n, k]. In detail, the audio signal processing apparatus 100 may convert a time domain input audio signal into a frequency domain signal through Fourier transform. The Fourier transform may include discrete Fourier transform (DFT) and fast Fourier transform (FFT) in which the discrete Fourier transform is processed through high speed calculation. Equation 1 represents frequency conversion of a time domain signal through the discrete Fourier transform.

$$SA[n,k]=\mathrm{DFT}\{TA[n]\}$$

$$SB[n,k]=\mathrm{DFT}\{TB[n]\}$$

$$SC[n,k]=\mathrm{DFT}\{TC[n]\} \qquad \text{[Equation 1]}$$

In Equation 1, n may denote a frame number, and k may denote a frequency bin index.

Next, the audio signal processing apparatus 100 may decompose each of the frequency-converted first to third input audio signals SA, SB, and SC based on the above-mentioned reference frequency. Referring to FIG. 5, the audio signal processing apparatus 100 may decompose each of the first to third input audio signals SA, SB, and SC into a high-frequency component that exceeds a cut-off frequency bin index kc corresponding to a cut-off frequency and a low-frequency component equal to or lower than the cut-off frequency bin index kc. In detail, the audio signal processing apparatus 100 may generate a high frequency filter and a low frequency filter based on a frequency. The audio signal processing apparatus 100 may generate a low-band audio signal corresponding to a frequency component that is equal to or lower than a reference frequency by filtering an input audio signal based on the low frequency filter. Furthermore, the audio signal processing apparatus 100 may generate high-band audio signals SA1H, SB1H, and SC1H corresponding to frequency components that exceed the reference frequency by filtering an input audio signal based on the high frequency filter.

Next, the audio signal processing apparatus 100 may obtain the cross-correlations between the first to third input audio signals SA, SB, and SC. According to an embodiment of the present disclosure, the audio signal processing apparatus 100 may obtain the cross-correlations between low-band audio signals generated from each of the first to third input audio signals SA, SB, and SC. The cross-correlations XAB, XBC, and XCA between the first to third input audio signals SA, SB, and SC may be expressed as Equation 2. In Equation 2, sqrt(x) denotes a square root of x.

$$XAB[n,k]=SA[n,k]*SB[n,k]/\mathrm{sqrt}((SA[n,k])\hat{}2+(SB([n,k])\hat{}2)$$

$$XBC[n,k]=SB[n,k]*SC[n,k]/\mathrm{sqrt}((SB[n,k])\hat{}2+(SC([n,k])\hat{}2)$$

$$XCA[n,k]=SC[n,k]*SA[n,k]/\mathrm{sqrt}((SC[n,k])\hat{}2+(SA([n,k])\hat{}2) \qquad \text{[Equation 2]}$$

Referring to FIG. 5, the audio signal processing apparatus 100 does not perform an additional process on the high-band audio signals SA1H, SB1H, and SC1H. This is because a high-band audio signal that exceeds the cut-off frequency has a short wavelength compared to the distance between microphones in the structure illustrated in FIG. 4, and thus a time delay and a value of a phase difference calculated from the time delay are not meaningful. Due to the above-mentioned characteristic, the audio signal processing apparatus 100 may generate output audio signals TA1, TA2, and TA3 based on the high-band audio signals SA1H, SB1H, and SC1H which have not undergone a process such as gain application that will be described later.

Next, the audio signal processing apparatus 100 may obtain time differences tXAB[n,k], tXBC[n,k], and tXCA [n,k] for each frequency component based on the cross-correlations XAB, XBC, and XCA between the first to third input audio signals SA, SB, and SC. According to an embodiment, the cross-correlations XAB, XBC, and XCA calculated from Equation 2 may be in a form of a complex number. In this case, the audio signal processing apparatus 100 may obtain phase components pXAB[n,k], pXBC[n,k], and pXCA[n,k] of each of the cross-correlations XAB, XBC, and XCA. Furthermore, the audio signal processing apparatus 100 may obtain, from the phase components, a time difference for each frequency component. In detail, the time difference for each frequency component according to the cross-correlations XAB, XBC, and XCA may be expressed as Equation 3.

$$tXAB[n,k]=N*pXAB(n,k)/(2*pi*FS*k)$$

$$tXBC[n,k]=N*pXBC(n,k)/(2*pi*FS*k)$$

$$tXCA[n,k]=N*pXCA(n,k)/(2*pi*FS*k) \qquad \text{[Equation 3]}$$

In Equation 3, N denotes the number of samples in a time domain included in one frame, and FS denotes a sampling frequency.

Next, the audio signal processing apparatus 100 may obtain, for each frequency component, incidence angles of a plurality of low-band audio signals incident to each of the first to third sound collecting devices 41 to 43. According to an embodiment, the audio signal processing apparatus 100 may obtain incidence angles aA, aB, and aC for each frequency component through calculations of Equation 4 and Equation 4 based on the cross-correlations XAB, XBC, and XCA obtained in a previous stage. For example, the audio signal processing apparatus 100 may obtain the incidence angles for each frequency component of the first to third input audio signals SA, SB, and SC based on a relationship between the time differences tXAB and tXCA for each frequency component obtained through Equation 3.

$$tA[n,k]=(tXAB[n,k]-tXCA[n,k])/\text{maxDelay}$$

$$tB[n,k]=(tXBC[n,k]-tXAB[n,k])/\text{maxDelay}$$

$$tC[n,k]=(tXCA[n,k]-tXBC[n,k])/\text{maxDelay} \quad \text{[Equation 4]}$$

$$aA[n,k]=\text{arc cos}(tA[n,k]/\text{sqrt}(3))$$

$$aB[n,k]=\text{arc cos}(tB[n,k]/\text{sqrt}(3))$$

$$aC[n,k]=\text{arc cos}(tC[n,k]/\text{sqrt}(3)) \quad \text{[Equation 5]}$$

The audio signal processing apparatus 100 may obtain, through Equation 4, a time value for calculating a gain from the cross-correlations tXAB and tXCA. Furthermore, the audio signal processing apparatus 100 may normalize the time value. In Equation 4, maxDelay may denote a maximum time delay value determined based on a distance d between the first to third sound collecting devices 41 to 43. Accordingly, the audio signal processing apparatus 100 may obtain normalized time values tA, tB, and tC for calculating a gain based on the maximum time delay value maxDelay. The incidence angles aA, aB, and aC may be expressed as Equation 5. Equation 5 indicates a method for the audio signal processing apparatus 100 to obtain an incidence angle for each frequency component when the first to third sound collecting devices 41 to 43 are arranged in a equilateral triangular form. In Equation 5, arc cos denotes an inverse cosine function. The audio signal processing apparatus 100 may obtain the incidence angles aA, aB, and aC for each frequency component in another way according to a structure in which the plurality of sound collecting devices are arranged.

Furthermore, according to an embodiment, the audio signal processing apparatus 100 may generate smoothed incidence angles aA, aB, and aC for each frequency component. The incidence angle aA for each frequency component calculated through Equation 5 varies according to a frame. Here, a smoothing function such as Equation 6 may be used to avoid an excessive variation.

$$aA[n,k]=(3*aA[n,k]+2*aA[n-1,k]+aA[n-2,k])/6 \quad \text{[Equation 6]}$$

Equation 6 indicates a weighted moving average method in which a largest weight is allocated to a determined incidence angle for each frequency component of a current frame, and a relatively small weight is allocated to an incidence angle for each frequency component of a past frame. However, the present disclosure is not limited thereto, and the weights may vary according to a purpose. Furthermore, the audio signal processing apparatus 100 may omit a smoothing process.

Next, the audio signal processing apparatus 100 may obtain gains gA, gB, gC, gA', gB', and gC' for each frequency component corresponding to the location of each of the first to third sound collecting devices 41 to 43 and first to third virtual sound collecting devices 44 to 46. For convenience, the following descriptions are provided based on a process applied to the first input audio signal. The embodiment described below may apply likewise to the second and third input audio signals SB and SC. The gain for each frequency component for the first input audio signal obtained through Equation 5 and Equation 6 may be expressed as Equation 7.

$$gA[n,k]=\cos(aA[n,k]/2)$$

$$gA'[n,k]=\sin(aA[n,k]/2) \quad \text{[Equation 7]}$$

Equation 7 indicates a gain for each frequency component corresponding to the location of each of the first sound collecting device 41 and the first virtual sound collecting device 44. Equation 7 indicates a gain for each frequency component obtained based on a cardioid characteristic. However, the present disclosure is not limited thereto, and the audio signal processing apparatus 100 may obtain the gain for each frequency component by using various methods based on an incidence angle for each frequency component.

Next, the audio signal processing apparatus 100 may generate intermediate audio signals SAIL, SB1L, SC1L, SA2, SB2, and SC2 corresponding to the location of each of the first to third sound collecting devices 41 to 43 and first to third virtual sound collecting devices 44 to 46 by rendering first to third low-band audio signals based on the gain for each frequency component. Equation 8 indicates the low-band intermediate audio signals SAIL and SA2 corresponding to each of the first sound collecting device 41 and the first virtual sound collecting device 44. The audio signal processing apparatus 100 may generate the low-band intermediate audio signal SAIL corresponding to the location of the first sound collecting device 41 based on a gain gA corresponding to the location of the first sound collecting device 41. Furthermore, the audio signal processing apparatus 100 may generate the low-band intermediate audio signal SA2 corresponding to the location of the first virtual sound collecting device 44 based on a gain gA' corresponding to the location of the first virtual sound collecting device 44.

$$SA1L[n,k]=gA[n,k]*SA[n,k], \text{ for } k<kc$$

$$SA2[n,k]=gA'[n,k]*SA[n,k], \text{ for } k<kc \quad \text{[Equation 8]}$$

Next, the audio signal processing apparatus 100 may generate intermediate audio signals TA1, TB1, TC1, TA2, TB2, and TC2 corresponding to the location of each of the first to third sound collecting devices 41 to 43 and first to third virtual sound collecting devices 44 to 46. Equation 9 indicates the intermediate audio signal SA1 corresponding to the first sound collecting device and the intermediate audio signal SA2 corresponding to the first virtual sound collecting device before performing inverse discrete Fourier transform (IDFT).

$$SA1[n,k]=gA[n,k]*SA1L[n,k], \text{ for } k<kc$$

$$SA1H[n,k], \text{ for } k>=kc$$

$$SA2[n,k]=gA'[n,k]*SA2[n,k], \text{ for } k<kc \quad \text{[Equation 9]}$$

The audio signal processing apparatus 100 may perform the inverse discrete Fourier transform on each of audio signals processed in a frequency domain to generate time domain intermediate audio signals TA1 and TA2. Furthermore, the audio signal processing apparatus 100 may convert the intermediate audio signals TA1, TB1, TC1, TA2, TB2, and TC2 into ambisonics signals to generate an output audio signal.

Figure 6:
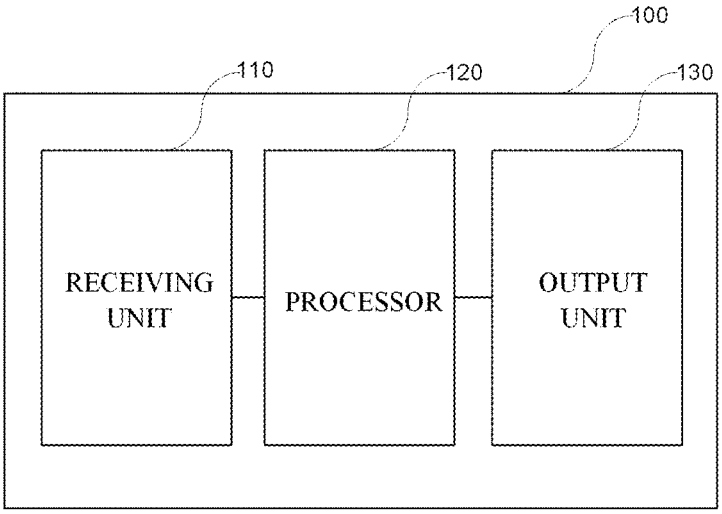
FIG. 6 is a block diagram illustrating a configuration of an audio signal processing apparatus according to an embodiment of the present disclosure.

According to an embodiment, the first to third sound collecting devices 41 to 43 and the first to third virtual sound collecting devices 44 to 46 may use independent ambisonics conversion matrices. This is because the first to third virtual sound collecting devices 44 to 46 differ in geometric location from the first to third sound collecting devices 41 to 43. The audio signal processing apparatus 100 may convert the intermediate audio signals corresponding to the first to third sound collecting devices 41 to 43 based on a first ambisonics conversion matrix ambEnc1. Furthermore, the audio signal processing apparatus 100 may convert the intermediate audio signals corresponding to the first to third virtual sound collecting devices 44 to 46 based on a second ambisonics conversion matrix ambEnc2.

$$Amb[n]=ambEnc1*T1[n]+ambEnc2*T2[n] \quad \text{[Equation 10]}$$

where T1[*n*]=[TA1[*n*], TB1[*n*], TC1[*n*]]T, T2[*n*]=[TA2[*n*], TB2[*n*], TC2[*n*]]T Although the audio signal processing apparatus 100 performs ambisonics conversion in a time domain with regard to Equation 10, this ambisonics conversion may be performed before inverse Fourier transform. In this case, the audio signal processing apparatus 100 may obtain a time domain output audio signal by performing the inverse Fourier transform on a frequency domain output audio signal converted into an ambisonics signal. Furthermore, for ease of calculation, the audio signal processing apparatus 100 may configure ambEnc1 and ambEnc2 as an integrated matrix as indicated by Equation 11 to perform a conversion operation. In Equation 10 and Equation 11, matrix [X]T denotes a transpose matrix of a matrix X.

$$Amb[n]=ambEnc*T[n] \quad \text{[Equation 11]}$$

where ambEnc=[ambEnc1 ambEnc2], T[n]=[TA1[*n*]TB1[*n*]TC1[*n*]TA2[*n*]TB2[*n*]TC2[*n*]]T FIG. 6 is a block diagram illustrating a configuration of the audio signal processing apparatus 100 according to an embodiment of the present disclosure. According to an embodiment, the audio signal processing apparatus 100 may include a receiving unit 110, a processor 120, and an output unit 130. However, all of the elements illustrated in FIG. 6 are not essential elements of the audio signal processing device. The audio signal processing apparatus 100 may further include elements not illustrated in FIG. 6. Furthermore, at least part of the elements of the audio signal processing apparatus 100 illustrated in FIG. 6 may be omitted.

The receiving unit 110 may receive an input audio signal. The receiving unit 110 may receive an input audio signal to be binaural-rendered by the processor 120. Here, the input audio signal may include at least one of an object signal or a channel signal. Here, the input audio signal may be one object signal or mono signal. Alternatively, the input audio signal may be a multi-object or multi-channel signal. According to an embodiment, when the audio signal processing apparatus 100 includes a separate decoder, the audio signal processing apparatus 100 may receive an encoded bitstream of the input audio signal.

According to an embodiment, the receiving unit 110 may obtain the input audio signal corresponding to a sound collected by a sound collecting device. Here, the sound collecting device may be a microphone. Furthermore, the receiving unit 110 may receive the input audio signal from a sound collecting array including a plurality of sound collecting devices. In this case, the receiving unit 110 may obtain the plurality of input audio signals corresponding to sounds collected by each of the plurality of sound collecting devices. The sound collecting array may be a microphone array including a plurality of microphones.

According to an embodiment, the receiving unit 110 may be provided with a receiving means for receiving the input audio signal. For example, the receiving unit 110 may include an audio signal input terminal for receiving the input audio signal transmitted by wire. Alternatively, the receiving unit 110 may include a wireless audio receiving module for receiving the audio signal transmitted wirelessly. In this case, the receiving unit 110 may receive the audio signal transmitted wirelessly by using a Bluetooth or Wi-Fi communication method.

The processor 120 may processor 120 may be provided with at least one processor to control overall operation of the audio signal processing apparatus 100. For example, the processor 120 may execute at least one program to control operation of the receiving unit 110 and the output unit 130. Furthermore, the processor 120 may execute at least one program to perform the operation of the audio signal processing apparatus 100 described above with reference to FIGS. 1 to 5. For example, the processor 120 may generate the output audio signal by rendering the input audio signal received through the receiving unit 110. For example, the processor 120 may match the input audio signal to a plurality of loud-speakers to render the input audio signal. Furthermore, the processor 120 may generate the output audio signal by binaural-rendering the input audio signal. The processor 120 may perform rendering in a time domain or frequency domain.

According to an embodiment, the processor 120 may convert a signal collected through the sound collecting array into an ambisonics signal. Here, the signal collected through the sound collecting array may be a signal recorded through a spherical sound collecting array. The processor 120 may obtain an ambisonics signal by converting, based on array information, the signal collected through the sound collecting device. Here, the ambisonics signal may be represented by ambisonics coefficients corresponding to spherical harmonics. Furthermore, the processor 120 may render the input audio signal based on location information related to the input audio signal. The processor 120 may obtain the location information related to the input audio signal. Here, the location information may include information about the location of each of a plurality of sound collecting devices that have collected sounds corresponding to the plurality of input audio signals. Furthermore, the location information related to the input audio signal may include information indicating the location of a sound source.

According to an embodiment, post-processing may be additionally performed on the output audio signal of the processor 120. The post-processing may include crosstalk removal, dynamic range control (DRC), sound volume normalization, peak limitation, etc. Furthermore, the post-processing may include frequency-time domain conversion for the output audio signal of the processor 120. The audio signal processing apparatus 100 may include a separate post-processing unit for performing the post-processing, and according to another embodiment, the post-processing unit may be included in the processor 120.

The output unit 130 may output the output audio signal. The output unit 130 may output the output audio signal generated by the processor 120. According to an embodiment, the output audio signal may be the above-mentioned ambisonics signal. The output unit 130 may include at least one output channel. For example, the output audio signal may be a 2-channel output audio signal corresponding to each of both ears of a listener. The output audio signal may be a binaural 2-channel output signal. The output unit 130 may output a 3D audio headphone signal generated by the processor 120.

According to an embodiment, the output unit 130 may be provided with an output means for outputting the output audio signal. For example, the output unit 130 may include an output terminal for externally outputting the output audio signal. Here, the audio signal processing apparatus 100 may output the output audio signal to an external apparatus connected to the output terminal. Alternatively, the output unit 130 may include a wireless audio transmitting module for externally outputting the output audio signal. In this case, the output unit 130 may output the output audio signal to an external apparatus by using a wireless communication method such as Bluetooth or Wi-Fi. Alternatively, the output unit 130 may include a speaker. Here, the audio signal processing apparatus 100 may output the output audio signal through the speaker. Furthermore, the output unit 130 may further include a converter (e.g., digital-to-analog converter (DAC)) for converting a digital audio signal to an analog audio signal.

Some embodiments may be implemented as a form of a recording medium including instructions, such as program modules, executable by a computer. A computer-readable medium may be any available medium accessible by a computer, and may include all of volatile and non-volatile media and detachable and non-detachable media. Furthermore, the computer-readable medium may include a computer storage medium. The computer storage medium may include all of volatile and non-volatile media and detachable and non-detachable media implemented by any method or technology for storing information such as computer-readable instructions, data structures, program modules, or other data.

Furthermore, in the present disclosure, the term "unit" may indicate a hardware component such as a processor or a circuit and/or a software component executed by a hardware component such as a processor.

The above description is merely illustrative, and it would be easily understood that those skilled in the art could easily make modifications without departing from the technical concept of the present disclosure or changing essential features. Therefore, the above embodiments should be considered illustrative and should not be construed as limiting. For example, each component described as a single type may be distributed, and likewise, components described as being distributed may be implemented as a combined form.

Although the present invention has been described using the specific embodiments, those skilled in the art could make changes and modifications without departing from the spirit and the scope of the present invention. That is, although the embodiments of binaural rendering for audio signals have been described, the present invention can be equally applied and extended to various multimedia signals including not only audio signals but also video signals. Therefore, any derivatives that could be easily inferred by those skilled in the art from the detailed description and the embodiments of the present invention should be construed as falling within the scope of right of the present invention.

What is claimed is:

1. An audio signal processing apparatus for generating an output audio signal by rendering an input audio signal, the audio signal processing apparatus comprising:

a receiving unit configured to obtain a plurality of input audio signals corresponding to sounds collected by each of a plurality of sound collecting devices, wherein each of the plurality of input audio signals corresponds to sound incident to each of the plurality of sound collection devices;

a processor configured to:

obtain an incidence direction for each frequency component for at least some frequency components of each of the plurality of input audio signals based on array information indicating a structure in which the plurality of sound collecting devices are arranged and cross-correlations between the plurality of input audio signals, and generate an output audio signal by rendering at least some of the plurality of input audio signals based on the incidence direction for each frequency component; and an output unit configured to output the generated output audio signal.

2. The audio signal processing apparatus of claim 1, wherein each of the plurality of input audio signals is a signal with same collecting gain for all directions, and wherein the processor is further configured to generate the output audio signal simulating a signal recorded with a directional pattern determined according to the incident direction for each frequency component, from the plurality of input audio signals.

3. The audio signal processing apparatus of claim 1, wherein the processor is further configured to generate the output audio signal by rendering some frequency components of the input audio signal based on the incidence direction for each frequency component, wherein the some frequency components indicate frequency components equal to or lower than at least a reference frequency, and wherein the reference frequency is determined based on at least one of the array information or frequency characteristics of the sounds collected by each of the plurality of sound collecting devices.

4. The audio signal processing apparatus of claim 3, wherein each of the plurality of input audio signals are decomposed into a first audio signal corresponding to a frequency component equal to or lower than the reference frequency and a second audio signal corresponding to a frequency component that exceeds the reference frequency, and wherein the processor is further configured to:

generate a third audio signal by rendering the first audio signal based on the incidence direction for each frequency component, and generate the output audio signal by concatenating the second audio signal and the third audio signal, for each frequency component.

5. The audio signal processing apparatus of claim 1, wherein the processor is further configured to:

obtain time differences between each of the plurality of input audio signals based on the cross-correlations, and obtain the incident direction for each frequency component of each of the plurality of input audio signals based on the time differences normalized with a maximum time delay, and wherein the maximum time delay is determined based on the distance between the plurality of sound collection devices.

6. The audio signal processing apparatus of claim 5, wherein a first input audio signal, which is one of the plurality of input audio signals, corresponds to a sound collected by a first sound collecting device which is one of the plurality of sound collecting devices, and wherein the processor is further configured to:

obtain a first gain for each frequency component corresponding to a location of the first sound collecting device and a second gain for each frequency component corresponding to a virtual location, based on the incidence direction for each frequency component of the first input audio signal, wherein the virtual location indicates a specific point in a sound scene which is the same as a sound scene corresponding to the sound collected by the plurality of sound collecting devices, generate a first intermediate audio signal corresponding to the location of the first sound collecting device by converting a sound level for each frequency component of the first input audio signal based on the first gain for each frequency component, generate a second intermediate audio signal corresponding to a virtual location by converting a sound level for each frequency component of the first input audio signal based on the first gain for each frequency component, and generate the output audio signal by synthesizing the first intermediate audio signal and the second intermediate audio signal.

7. The audio signal processing apparatus of claim 6, wherein the virtual location is a specific point within a range of a preset angle from the location of the first sound collecting device, based on a center of a sound collecting array comprising the plurality of sound collecting devices.

8. The audio signal processing apparatus of claim 7, wherein the preset angle is determined based on the array information.

9. The audio signal processing apparatus of claim 8, wherein each of a plurality of virtual locations comprising the virtual location is determined based on a location of each of the plurality of sound collecting devices and the preset angle, and wherein the processor is further configured to:

obtain a first ambisonics signal based on the array information, obtain a second ambisonics signal based on the plurality of virtual locations, and generate the output audio signal based on the first ambisonics signal and the second ambisonics signal.

10. The audio signal processing apparatus of claim 9, wherein the first ambisonics signal comprises an audio signal corresponding to the location of each of the plurality of sound collecting devices, and the second ambisonics signal comprises an audio signal corresponding to the plurality of virtual locations.

11. The audio signal processing apparatus of claim 5, wherein the processor is further configured to set a sum of an energy level for each frequency component of the first intermediate audio signal and an energy level for each frequency component of the second intermediate audio signal to be equal to an energy level for each frequency component of the first input audio signal.

12. The audio signal processing apparatus of claim 6, wherein each of a plurality of virtual locations comprising the virtual location indicate a location of another sound collecting device other than the first sound collecting device among the plurality of sound collecting devices, and wherein the processor is further configured to:

obtain each of a plurality of intermediate audio signals corresponding to a location of each of the plurality of sound collecting devices based on the incidence direction for each frequency component of the first input audio signal, and generate the output audio signal by converting the plurality of intermediate audio signals into ambisonics signals based on the array information.

13. A method for operating an audio signal processing apparatus for generating an output audio signal by rendering an input audio signal, the method comprising:

obtaining a plurality of input audio signals corresponding to sounds collected by each of a plurality of sound collecting devices, wherein each of the plurality of input audio signals corresponds to a sound incident to each of the plurality of sound collection devices;

obtaining an incidence direction for each frequency component for at least some frequency components of each of the plurality of input audio signals based on array information indicating a structure in which the plurality of sound collecting devices are arranged and cross-correlations between the plurality of input audio signals;

generating an output audio signal by rendering at least some of the plurality of input audio signals based on the incidence direction for each frequency component; and outputting the generated output audio signal.

14. The method of claim 13, wherein each of the plurality of input audio signals is a signal with same collecting gain for all directions, and wherein the generating the output audio signal is generating the output audio signal simulating a signal recorded with a directional pattern determined according to the incident direction for each frequency component, from the plurality of input audio signals.

15. The method of claim 13, wherein the generating the output audio signal is generating the output audio signal by rendering some frequency components of the input audio signal based on the incidence direction for each frequency component, wherein the some frequency components indicate frequency components equal to or lower than at least a reference frequency, and wherein the reference frequency is determined based on at least one of the array information or frequency characteristics of the sounds collected by each of the plurality of sound collecting devices.

16. The method of claim 15, wherein each of the plurality of input audio signals are decomposed into a first audio signal corresponding to a frequency component equal to or lower than the reference frequency and a second audio signal corresponding to a frequency component that exceeds the reference frequency, and wherein the generating the output audio signal comprises:

generating a third audio signal by rendering the first audio signal based on the incidence direction for each frequency component; and generating the output audio signal by concatenating the second audio signal and the third audio signal for each frequency component.

17. The method of claim 13, wherein a first input audio signal which is one of the plurality of input audio signals corresponds to a sound collected by a first sound collecting device which is one of the plurality of sound collecting devices, wherein the generating the output audio signal comprises:

obtaining a first gain for each frequency component corresponding to a location of the first sound collecting device and a second gain for each frequency component corresponding to a virtual location, based on the incidence direction for each frequency component of the first input audio signal, wherein the virtual location indicates a specific point in a sound scene which is the same as a sound scene corresponding to the sound collected by the plurality of sound collecting devices;

generating a first intermediate audio signal corresponding to the location of the first sound collecting device by converting a sound level for each frequency component of the first input audio signal based on the first gain for each frequency component;

generating a second intermediate audio signal corresponding to a virtual location by converting a sound level for each frequency component of the first input audio signal based on the first gain for each frequency component; and generating the output audio signal by synthesizing the first intermediate audio signal and the second intermediate audio signal.

18. The method of claim 17, wherein each of a plurality of virtual locations comprising the virtual location is determined based on a location of each of the plurality of sound collecting devices, and wherein the generating the output audio signal comprises:

obtaining a first ambisonics signal based on array information indicating a structure in which the plurality of sound collecting devices are arranged;

obtaining a second ambisonics signal based on the plurality of virtual locations; and generating the output audio signal based on the first ambisonics signal and the second ambisonics signal.

19. A non-transitory computer-readable recording medium in which a program for executing the method of claim 13 is recorded.

* * * * *